US006193555B1

(12) United States Patent
Chang

(10) Patent No.: US 6,193,555 B1
(45) Date of Patent: Feb. 27, 2001

(54) ESD AND CROSSTALK PROTECTED HYBRID CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/454,942

(22) Filed: Dec. 2, 1999

(30) Foreign Application Priority Data

Oct. 29, 1999 (TW) ..... 088218475

(51) Int. Cl.[7] ..... H01R 4/66

(52) U.S. Cl. ..... 439/608; 439/108

(58) Field of Search ..... 439/608, 609, 439/108

(56) References Cited

U.S. PATENT DOCUMENTS 5,772,472 * 6/1998 Beutler et al. ..... 439/608

5,961,350 * 10/1999 Shiu ..... 439/108 X

* cited by examiner

*Primary Examiner*—Renee Luebke
(74) *Attorney, Agent, or Firm*—Wei Te Chung

(57) ABSTRACT

An electrical connector of the present invention comprises an elongate housing having a forwardly projecting mating portion, a number of data terminals and signal terminals received in the mating portion, a metallic blade fixed in the mating portion, a conductive shield enclosing the housing and a pair of metallic board locks. The mating portion of the housing includes a first portion for receiving the data terminals, a second portion for receiving the signal terminals and a gap defined between the first and second portion for accommodating the blade. The metallic blade comprises a base fitting between the first portion and the second portion of the housing, a pair of side wings depending from top/bottom edges of the base, and a pair of fingers rearwardly extending from the side wings and extending along top and bottom surfaces of the second portion for contacting the shield. The shield connects with the board locks to ground thereby grounding the blade. The grounded blade not only reduces crosstalk and capacitive coupling between the data terminals and the signal terminals but also minimizes the risk of ESD.

7 Claims, 4 Drawing Sheets

ESD AND CROSSTALK PROTECTED HYBRID CONNECTOR

BACKGROUND OF THE INVENTION

1. The Field of the Invention

The present invention relates to a hybrid connector, and particularly to the terminals of a hybrid connector with reliable ESD and EMI protection.

2. Brief Description of the Prior Art

U.S. Pat. No. 5,344,327 discloses a hybrid connector which provides an opening in a housing between a plurality of first terminals and a plurality of second terminals. The opening, in essence, establishes a region of reduced electric permitivity thereby reducing capacitive coupling and crosstalk between the plurality of first and second terminals. As is well known, a metal plate can provide more satisfying protection against capacitive coupling and crosstalk than an air gap can.

Protection from electrostatic discharge (ESD) is also important, particularly to electrical devices which are sensitive to applied voltages. Although the disclosed connector provides protection against crosstalk and capacitive coupling between the first and second terminals, it provides no ESD protection.

Hence, an improved electrical connector is required to overcome the disadvantages of the prior art.

BRIEF SUMMARY OF THE INVENTION

A first object of the present invention is to provide an improved hybrid connector which has a grounded blade for reducing crosstalk and capacitive coupling between a plurality of first terminals and a plurality of second terminals; and A second object of the present invention is to provide an improved hybrid connector which has a grounded blade which protects against ESD.

To achieve the above-mentioned objects, a connector includes an elongate housing having a mating portion separated into two sides, a plurality of data terminals received in the first side and a plurality of high speed signal terminals and a grounding terminal received in the second side, a metallic blade fitting into a gap in the mating portion which separates the two sides of the mating portion, and a conductive shield having a plurality of claws and surrounding the mating portion.

The mating portion forwardly projects from a body portion of the housing which further includes a pair of recesses for accommodating a pair of conductive board locks therein. The second side of the mating portion forms a plurality of blocks extending into the gap and defines a pair of grooves at its upper and lower sides, the grooves being in communication with the gap.

The blade comprises a base, a pair of side wings depending horizontally from the base and a pair of resilient fingers respectively rearwardly extending from the side wings. The base has a plurality of bumps for interferentially engaging with the blocks of the mating portion to secure the blade in the gap. Each resilient finger is outwardly extending and forms an engaging embossment at a tip thereof for reliably contacting the shield.

In assembly, the base of the blade is inserted into the gap and the plurality of bumps thereof interferentially mates with the blocks of the mating portion while the side wings of the blade are received in the grooves of the mating portion. The shield is assembled to the housing and the fingers of the blade contact the shield. The claws of the shield are then bent to secure the shield to the housing while concurrently engaging with the board locks, thereby establishing an electrical connection to ground. Therefore, the metallic blade interposed between the signal terminals and the data terminals is grounded, thereby reducing crosstalk and capacitive coupling between them and dissipating ESD.

Other objects, advantages and novel features of the invention will become more apparent from the following detailed description of the present embodiment when taken in conjunction with the accompanying drawings.

DETAILED DESCRIPTION OF THE INVENTION

Figure 1:
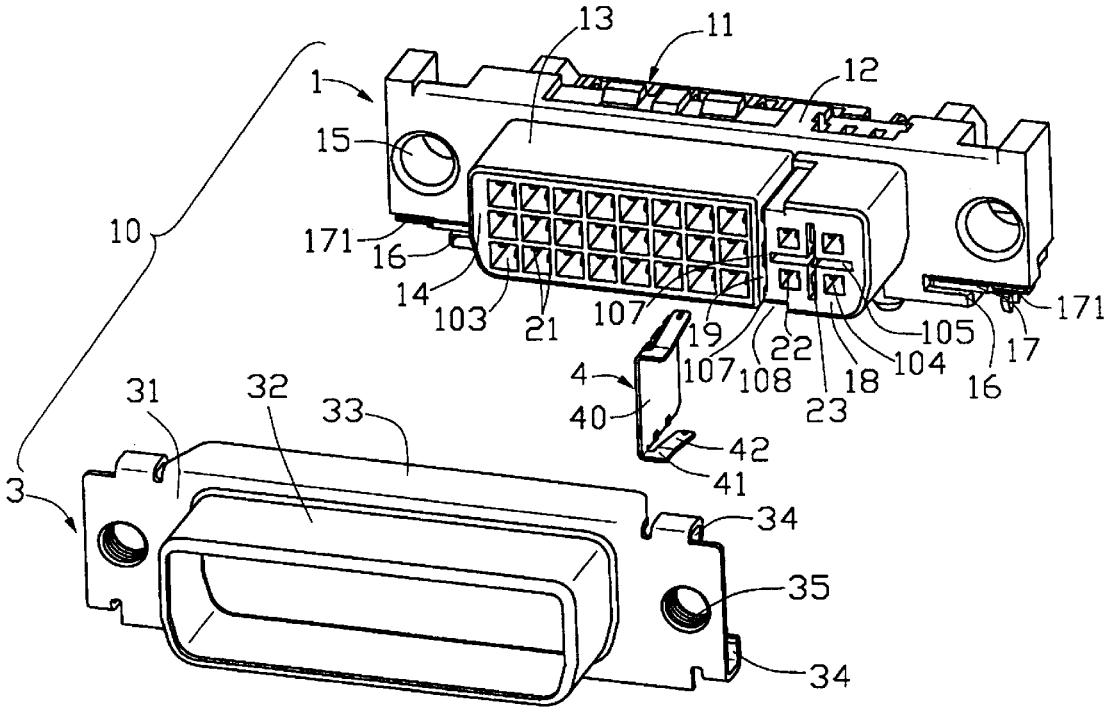
FIG. 1 is a partially exploded view of a hybrid connector of the present invention.

Referring to FIG. 1, a hybrid connector 10 comprises an elongated dielectric housing 1 having a mating portion 13 forwardly projecting from a body portion 12 thereof, a plurality of data terminals 21, a plurality of signal terminals 22, a grounding terminal 23, and a pair of board locks 17 received in the housing 1, a conductive shield 3 surrounding the mating portion 13 of the housing 1, and a metallic blade 4 inserted in the mating portion 13 of the housing 1.

The body portion 12 of the housing 1 defines a receiving opening 11 at a rear end thereof, a pair of positioning holes 15 at opposite lateral ends thereof, and a pair of receiving recesses 16 disposed at lateral lower ends thereof for receiving the pair of board locks 17.

The mating portion 13 of the housing 1 forwardly depending from the body portion 12 comprises a first portion 14, a second portion 18 and a gap 19 defined between the first portion 14 and the second portion 18. A plurality of data terminal receiving passages 103 is disposed in the first portion 14 in three parallel rows and communicates with the receiving opening 11 for receiving a plurality of data terminals 21 therein. The second portion 18 defines four signal terminal receiving passages 104 separated by a cross-shaped grounding terminal receiving passage 105. The plurality of signal terminal receiving passages 104 extends rearwardly through the housing 1 for receiving the plurality of high speed signal terminals 22 therein. The grounding terminal receiving passage 105 extends rearwardly through the housing 1 for receiving a grounding terminal 23 for establishing a grounding connection with a complementary connector (not shown). A plurality of uniformly spaced blocks 107 horizontally extends into the gap 19 from an interior side surface of the second portion 18. A pair of grooves 108 symmetrically defined in an upper end and a lower end of the second portion 18 extends rearwardly from a front edge of the second portion 18 and communicates with the gap 19.

Figure 2:
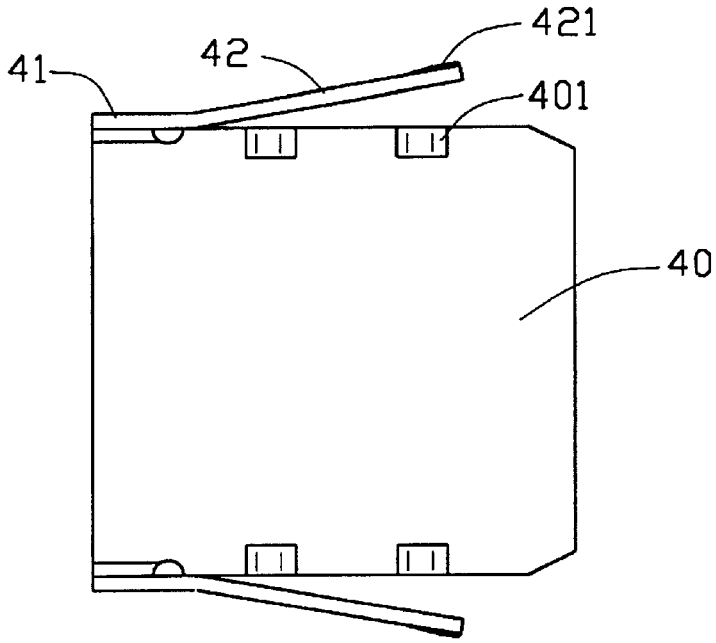
FIG. 2 is a side view of a blade of FIG. 1.
Figure 3:
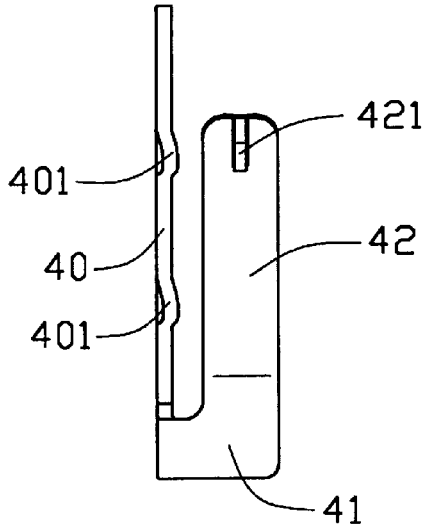
FIG. 3 is a top view of the blade of FIG. 1.

The metallic blade 4 is symmetric (further referring to FIGS. 2 and 3) and is stamped and formed for slidable insertion between the first portion 14 and the second portion 18. The blade 4 includes a flat base 40, a pair of side wings 41 respectively extending from top and bottom edges of the base 40 in a single direction for coupling with the grooves 108 of the second portion 18, and a pair of fingers 42 rearwardly extending from the side wings 41. The base 40 further forms a plurality of bumps 401 adjacent opposite edges thereof for interferentially engaging with the blocks 107 of the second portion 18. The fingers 42 outwardly extend for resiliently contacting the shield 3 and each finger 42 forms an engaging embossment 421 at a tip thereof for reliably mating with the shield 3.

The shield 3 includes a plate 31 and a shroud 32 forwardly depending from the plate 31 for surrounding the mating portion 13 of the housing 1. The plate 31 forms a flange 33 rearwardly extending from a top edge thereof and a plurality of claws 34 at opposite lateral ends thereof for latching with the housing 1. Two lower claws 34 respectively press a grounding tab 171 of the board lock 17 against the housing 1 thereby securing the board locks 17 in position and establishing electrical connection between the board locks 17 and the shield 3 (see FIGS. 1 and 4). The positioning sleeves 35 are aligned with the positioning holes 15 of the housing 1.

Figure 4:
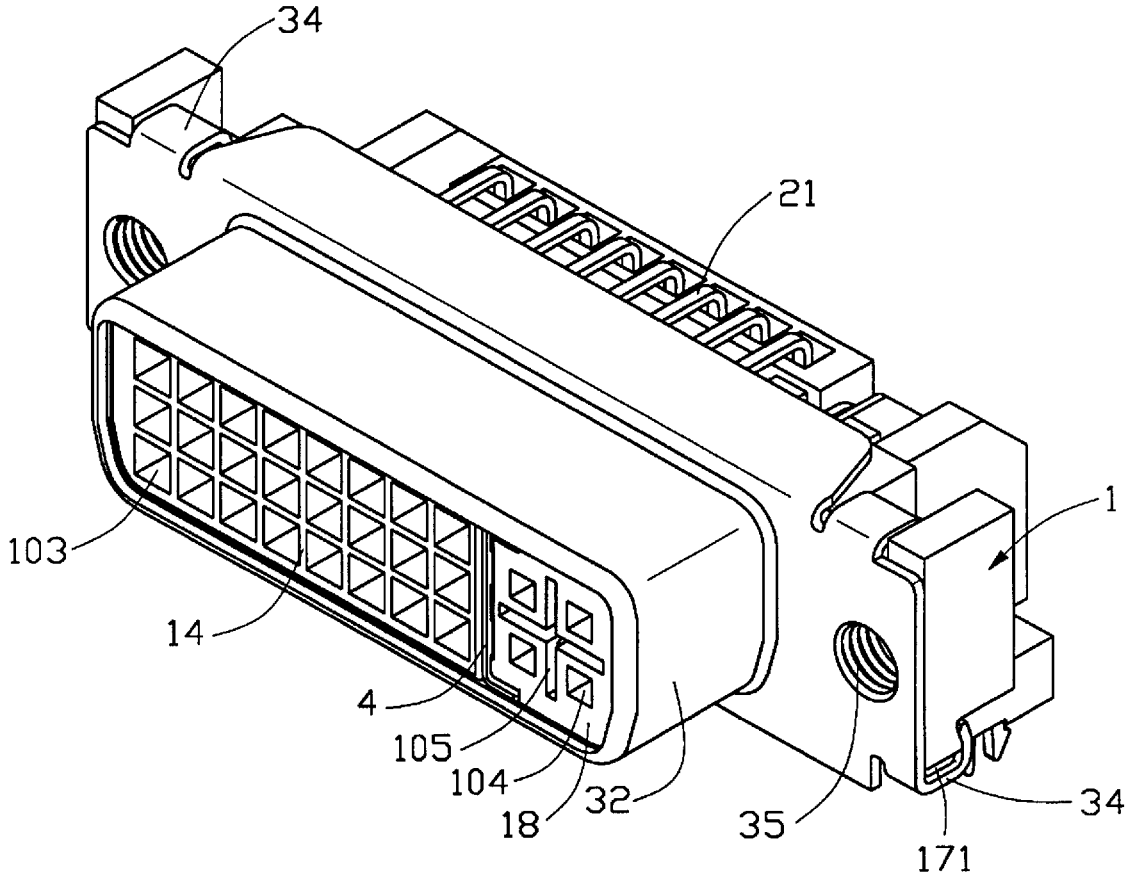
FIG. 4 is an assembled view of the connector of FIG. 1.
Figure 5:
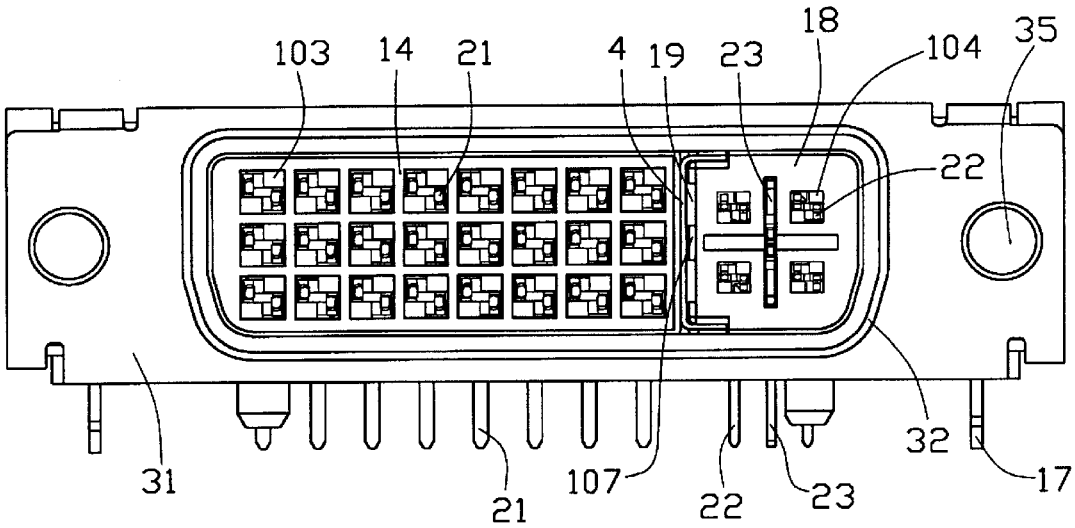
FIG. 5 is a front view of the connector of FIG. 1.

In assembly, as shown in FIGS. 4 and 5, the data terminals 21, the signal terminals 22 and the grounding terminal 23 are initially received in corresponding receiving passages 103, 104 and 105. The pair of board locks 17 is rearwardly inserted into the receiving recesses 16 from a front of the housing 1. The base 40 of the blade 4 then rearwardly slides into the gap 19 between the first portion 14 and the blocks 107 of the second portion 18 while the side wings 41 of the blade 4 are received in the grooves 108 of the second portion 18. The plurality of bumps 401 interferentially mates with the corresponding blocks 107 whereby the blade 4 is reliably secured in the housing 1. The shield 3 is finally rearwardly assembled on the housing 1, the positioning sleeves 35 inserting into the positioning holes 15 of the housing 1 and the engaging embossments 421 of the fingers 42 of the blade 4 tightly pressing against interior surfaces of the shield 3 for establishing a grounding path through the shield 3. The claws 34 of the shield 3 are bent to engage with the housing 1 and contact the board locks 17 for establishing a grounding path from the shield to a printed circuit board.

The blade 4 is thus grounded through the shield 3 thereby reliably reducing capacitive coupling and crosstalk between the plurality of data terminals 21 and the plurality of signal terminals 22. The grounded blade 4 also assists in protecting the connector 10 from ESD.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising a dielectric housing, a grounded shield enclosing the housing, and a plurality of first terminals and second terminals received in the housing, wherein the improvement comprises:

a metallic blade being provided for reducing crosstalk and capacitive coupling between the plurality of first terminals and the plurality of second terminals and for dissipating ESD (Electro-Static Discharge), the blade including a base secured in the dielectric housing between the plurality of first terminals and the plurality of second terminals, a pair of side wings depending from the base, and a pair of fingers extending from the side wings and protruding beyond the housing for contacting the grounded shield.

2. The electrical connector as claimed in claim 1, wherein the housing has a projecting mating portion, the mating portion including a first portion for receiving the plurality of first terminals, a second portion for receiving the plurality of second terminals, and a gap separating the first and second portions.

3. The electrical connector as claimed in claim 2, wherein the second portion of the mating portion forms a plurality of blocks extending into the gap and defines a pair of grooves extending rearwardly from a front thereof in communication with the gap.

4. The electrical connector as claimed in claim 3, wherein each of the fingers of the blade outwardly extends to contact the grounded shield, and wherein the base has a plurality of bumps for interferentially engaging with the blocks of the second portion.

5. The electrical connector as claimed in claim 1, wherein the blade is stamped and formed from a sheet of metal plate.

6. The electrical connector as claimed in claim 1, wherein each of the fingers of the blade forms an engaging embossment at a rear end thereof for reliably contacting the shield.

7. An electrical connector comprising:

a dielectric housing defining a body portion and a mating portion forwardly extending from the body portion;

a grounding shield retained to said housing and enclosing said mating portion;

said mating portion defining a first portion and a second portion respectively receiving a larger amount of first terminals and a smaller amount of second terminals therein;

a gap vertically defined between said first portion and said second portion and extending through substantially the whole mating portion along a front-to-back direction thereof;

at least a groove formed in the second portion in communication with the gap; and a metallic blade including a base received within said gap, at least a side wing extending perpendicular to said base and received within said groove, and at least a finger extending from the wing and mechanically and electrically engaged with the shield.

* * * * *